US008337236B2

(12) United States Patent
Shu

(10) Patent No.: US 8,337,236 B2
(45) Date of Patent: Dec. 25, 2012

(54) SECURING APPARATUS FOR CONNECTOR

(75) Inventor: Si-Wen Shu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/095,920

(22) Filed: Apr. 28, 2011

(65) Prior Publication Data

US 2012/0171883 A1 Jul. 5, 2012

(30) Foreign Application Priority Data

Dec. 29, 2010 (CN) ..... 2010 1 0612230

(51) Int. Cl.
*H01R 13/62* (2006.01)

(52) U.S. Cl. ..... 439/369

(58) Field of Classification Search ..... 439/369, 439/371, 373, 147
See application file for complete search history.

(56) References Cited

U.S. PATENT DOCUMENTS

| | | | | |
|---|---|---|---|---|
| 2,753,536 | A * | 7/1956 | Tjader | 439/369 |
| 4,457,571 | A * | 7/1984 | Lavine et al. | 439/369 |
| 4,618,200 | A * | 10/1986 | Roberts et al. | 439/367 |
| 4,840,577 | A * | 6/1989 | Prouty | 439/373 |
| 5,348,495 | A * | 9/1994 | Kasden | 439/371 |
| 6,056,580 | A * | 5/2000 | Cross et al. | 439/369 |
| 6,071,142 | A * | 6/2000 | Blackman | 439/373 |
| 6,080,004 | A * | 6/2000 | Kovacik et al. | 439/369 |
| 7,186,130 | B1 * | 3/2007 | Miller | 439/369 |
| 7,452,233 | B1 * | 11/2008 | Michelsen | 439/369 |

* cited by examiner

*Primary Examiner* — Alexander Gilman
(74) *Attorney, Agent, or Firm* — Altis Law Group, Inc.

(57) ABSTRACT

A securing apparatus includes a receiving portion, and two resilient arms. The receiving portion defines a receiving space through front and rear ends of the receiving portion. The resilient arms respectively extend away from each other from opposite sides of the rear end of the receiving portion. Rear ends of the resilient arms are capable of moving towards each other and being locked together, to allow a connector to be received between the resilient arms.

15 Claims, 3 Drawing Sheets

SECURING APPARATUS FOR CONNECTOR

BACKGROUND

1. Technical Field

The present disclosure relates to securing apparatus for connectors.

2. Description of Related Art

An electronic device, such as a computer, generally includes a number of connector interfaces. However, some connectors, such as universal serial bus (USB) connectors, do not include hooking portions to lock the connectors to the corresponding connector interfaces, so the connectors may loosen and disconnect due to vibrations or movement of the connector cables.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawing, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
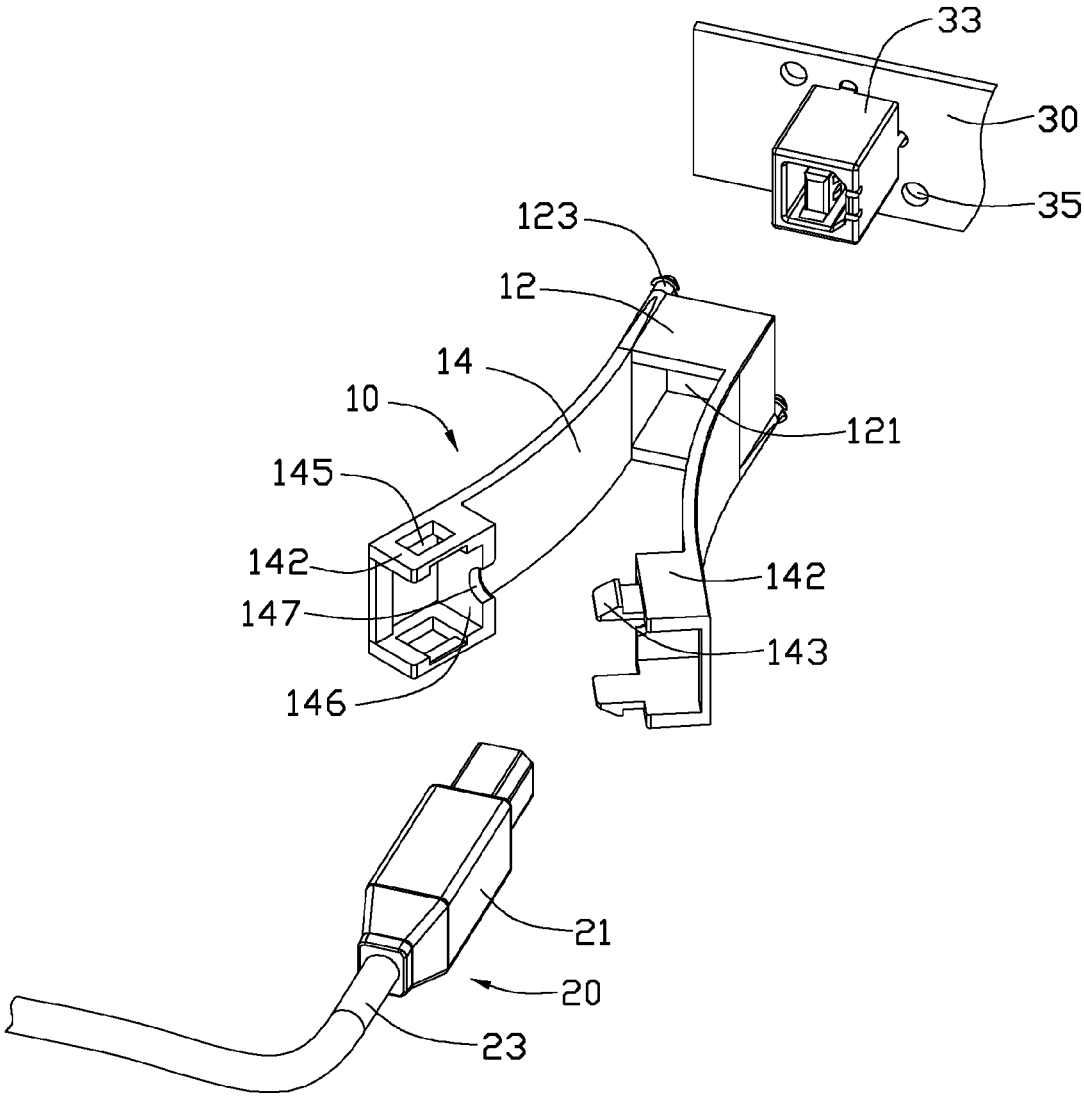
FIG. 1 is an exploded, isometric view of an embodiment of a securing apparatus together with a connector and a mounting plate.

Referring to FIG. 1, an embodiment of a securing apparatus is provided to protect a connector 20 from disconnecting from a connector interface 33 of a mounting plate 30. The connector 20 includes a main body 21, and a cable 23 connected to a rear end of the main body 21. Two holes 35 are defined in the mounting plate 30 at opposite sides of the connector interface 33. In this embodiment, the mounting plate 30 is a circuit board, and the connector interface 33 is installed on the circuit board. In other embodiments, the mounting plate 30 is a portion of a chassis of an electronic device, and the connector interface 33 is installed in the chassis and partially exposed out of the mounting plate 30.

The securing apparatus includes a receiving portion 12, and two resilient arms 10. A receiving space 121 is defined in the receiving portion 12 through front and rear ends of the receiving portion 12. Each resilient arm 10 extends back and out from opposite sides of the rear end of the receiving portion 12. Each resilient arm 10 includes an arc-shaped resilient plate 14 connected to the receiving portion 12, and a latching mechanism formed on a rear end of the resilient plate 14. Each latching mechanism includes two fixing plates 142 respectively extending in from top and bottom of a distal end of the corresponding resilient plate 14 away from the receiving portion 12. Two hooks 143 extend from distal ends of the fixing plates 142 of one of the latching mechanisms. Two slots 145 are respectively defined in the fixing plates 142 of the other latching mechanism. A stop plate 146 is connected between front ends of the fixing plates 142 of each resilient arm 10. A semi-circular notch 147 is defined in an end of each stop plate 146 away from the corresponding resilient plate 14. Two latching portions 123 extend forwards from the front end of the receiving portion 12, corresponding to the holes 35 of the mounting plate 30, respectively.

Figure 2:
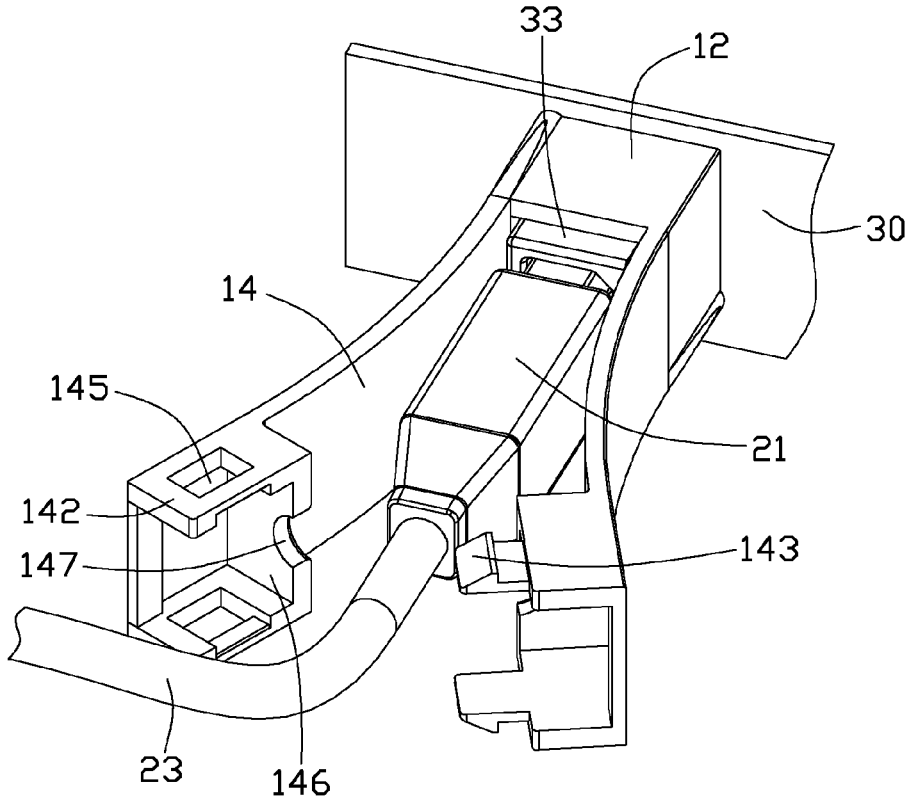
FIG. 2 is an assembled, isometric view of FIG. 1.
Figure 3:
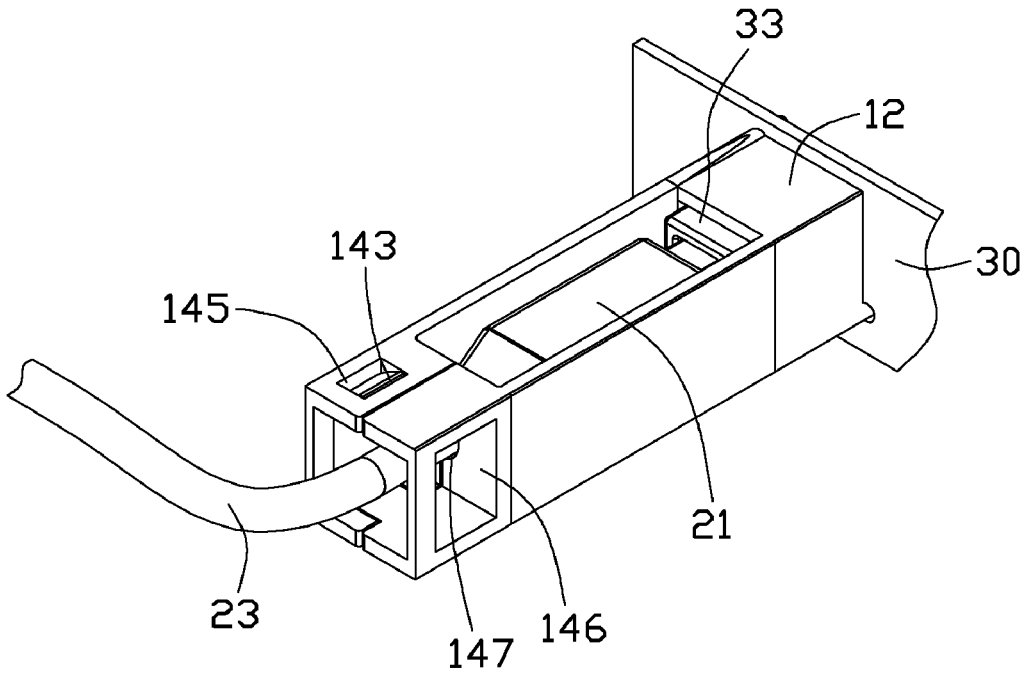
FIG. 3 is similar to FIG. 2, but shows the securing apparatus in a different state.

Referring to FIGS. 2 and 3, in assembly, the securing apparatus is pushed towards the connector interface 33, to allow the connector interface 33 to be received in the receiving portion 12. The latching portions 123 engage in the corresponding holes 35 of the mounting plate 30. Thereby, the securing apparatus is fixed to the mounting plate 30. A distal end of the connector interface 33 is exposed out of the rear end of the receiving portion 12. The connector 20 is connected to the connector interface 33, with the main body 21 received between the resilient arms 10. The resilient arms 10 are deformed towards each other. When the hooks 143 of one of the resilient arms 10 abut against the corresponding fixing plates 142 of the other resilient arm 10, the hooks 143 are deformed towards each other. The hooks 143 slide along inner surfaces of the corresponding fixing plates 142 until the hooks 143 align with the corresponding slots 145. The hooks 143 are restored to engage in the corresponding slots 145. Thereby, the resilient arms 10 are locked together. The stop plates 146 of the resilient arms 10 engage with each other, and the notches 147 of the stop plates 146 align with each other. The main body 21 of the connector 20 is bounded by the receiving portion 12, the stop plates 146, and the resilient plates 14. The cable 23 of the connector 20 is extended through the notches 147 of the stop plates 146 and exposed out of the securing apparatus. The connector 20 is protected by the securing apparatus from being loosened and disconnected by vibration or other movement.

To detach the connector 20 from the connector interface 33, the hooks 143 are disengaged from the corresponding slots 145. The resilient arms 10 are restored to move away from each other. The connector 20 can be detached from the connector interface 33 between the resilient arms 10.

It is to be understood, however, that even though numerous characteristics and advantages of the embodiments have been set forth in the foregoing description, together with details of the structure and function of the embodiments, the disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. A securing apparatus, comprising:

a receiving portion defining a receiving space through front and rear ends of the receiving portion; and two resilient arms respectively extending away from each other from opposite sides of the rear end of the receiving portion, rear ends of the resilient arms capable of being caused to move towards each other and locked to each other, wherein each of the resilient arms comprises a resilient plate extending from the rear end of the receiving portion, and a latching mechanism formed on a distal end of the resilient plate, the latching mechanisms of the resilient arms are operable to be locked to each other, each of the latching mechanisms comprises two fixing plates respectively extending inwards from opposite sides of the corresponding resilient plate, two slots are respectively defined in the fixing plates of one of the latching mechanisms, and two hooks are respectively formed on distal ends of the fixing plates of the other latching mechanism, to engage in the corresponding slots.

2. The securing apparatus of claim 1, wherein the resilient plate are arc-shaped.

3. The securing apparatus of claim 1, wherein a stop plate is connected between front ends of the fixing plates of each resilient arm.

4. The securing apparatus of claim 3, wherein a notch is defined in an end of each stop plate away from the corresponding resilient plate, when the resilient arms are locked to each other, the stop plates engage with each other, and the notches align with each other.

5. The securing apparatus of claim 1, wherein two latching portions extend forwards from the front end of the receiving portion.

6. A securing apparatus, to protect a connector from disconnecting from a connector interface of a mounting plate, the connector comprising a main body and a cable, the securing apparatus comprising:

a receiving portion detachably fixed to the mounting plate, a receiving space defined in the receiving portion through front and rear ends of the receiving portion, to receive the connector interface; and two resilient arms respectively extending back and out from opposite sides of the rear end of the receiving portion, rear ends of the resilient arms capable of being caused to move towards each other and locked together, to allow the main body of the connector to be received between the resilient arms when the connector is connected to the connector interface, wherein each of the resilient arms comprises a resilient plate, and a latching mechanism formed on a distal end of the resilient plate, the latching mechanisms of the resilient arms are operable to be locked to each other, each of the latching mechanisms comprises two fixing plates respectively extending inwards from opposite sides of the corresponding resilient plate, two slots are respectively defined in the fixing plates of one of the latching mechanisms, and two hooks are respectively formed on distal ends of the fixing plates of the other latching mechanism, to engage in the corresponding slots.

7. The securing apparatus of claim 6, wherein the resilient plate are arc-shaped.

8. The securing apparatus of claim 6, wherein a stop plate is formed on a rear end of an inner side of each resilient plate.

9. The securing apparatus of claim 8, wherein a notch is defined in an end of each stop plate away from the corresponding resilient plate, when the resilient arms are locked to each other, the stop plates engage with each other, and the notches align with each other, to allow the cable of the connector to extend through.

10. The securing apparatus of claim 6, wherein two latching portions extend forwards from the front end of the receiving portion, to engage in two corresponding holes defined in the mounting plate around the connector interface.

11. A securing apparatus, to protect a connector from disconnecting from a connector interface of a mounting plate, the connector comprising a main body and a cable, the securing apparatus comprising:

a receiving portion detachably fixed to the mounting plate, a receiving space defined in the receiving portion through front and rear ends of the receiving portion, to receive a front end of the main body of the connector; and two resilient arms respectively extending back and out from opposite sides of the rear end of the receiving portion, wherein a rear end of one of the resilient arms defines at least one slot, and a rear end of the other one of the resilient arms forms at least one hook, the rear ends of the resilient arms are capable of being caused to move towards each other, to allow said at least one hook to engage in said at least one slot, and to allow the main body of the connector to be received between the resilient arms when the connector is connected to the connector interface.

12. The securing apparatus of claim 11, wherein each of the resilient arms comprises a resilient plate, and two fixing plates respectively extending inwards from opposite sides of the resilient plate, the number of said at least one slot is two, and the number of said at least one hook is two, said two slots are respectively defined in the fixing plates of one of the resilient arms, and said two hooks are respectively formed on distal ends of the fixing plates of the other resilient arm.

13. The securing apparatus of claim 11, wherein a stop plate is formed on a rear end of an inner side of each resilient arm in front of the corresponding slot or hook for blocking a rear end of the main body of the connector.

14. The securing apparatus of claim 13, wherein a notch is defined in a distal end of each stop plate, when the resilient arms are locked to each other, the stop plates engage with each other, and the notches align with each other, to allow the cable of the connector to extend through.

15. The securing apparatus of claim 11, wherein two latching portions extend forwards from the front end of the receiving portion, to engage in two corresponding holes defined in the mounting plate around the connector interface.

* * * * *